US008428222B2

(12) United States Patent
Steinlage et al.

(10) Patent No.: US 8,428,222 B2
(45) Date of Patent: Apr. 23, 2013

(54) X-RAY TUBE TARGET AND METHOD OF REPAIRING A DAMAGED X-RAY TUBE TARGET

(75) Inventors: Gregory Alan Steinlage, Hartland, WI (US); Michael Scott Hebert, Franklin, WI (US)

(73) Assignee: General Electric Company, Schenectady, NY (US)

( * ) Notice: Subject to any disclaimer, the term of this patent is extended or adjusted under 35 U.S.C. 154(b) by 417 days.

(21) Appl. No.: 12/651,010

(22) Filed: Dec. 31, 2009

(65) Prior Publication Data

US 2011/0007872 A1 Jan. 13, 2011

Related U.S. Application Data

(63) Continuation-in-part of application No. 11/737,932, filed on Apr. 20, 2007.

(51) Int. Cl.
*H01J 35/10* (2006.01)
*H01J 35/08* (2006.01)

(52) U.S. Cl.
USPC ..... 378/144; 378/143

(58) Field of Classification Search ..... 378/125–133, 378/141, 143, 144, 210; 250/399, 427, 493.1, 250/526
See application file for complete search history.

(56) References Cited

U.S. PATENT DOCUMENTS 3,842,305 A 10/1974 Braun
3,993,923 A 11/1976 Magendans et al.
4,090,103 A 5/1978 Machenschalk et al.
4,132,917 A 1/1979 Bildstein et al.
4,195,247 A 3/1980 Hirsch
4,225,789 A 9/1980 Albrecht
4,271,372 A 6/1981 Geldner et al.
4,299,860 A 11/1981 Schaefer et al.
4,516,255 A 5/1985 Petter et al.
4,613,386 A 9/1986 Yates et al.
4,641,334 A 2/1987 Devine, Jr.
4,645,121 A 2/1987 Devine, Jr.
4,689,810 A 8/1987 Devine, Jr.
4,799,250 A 1/1989 Penato et al.
4,958,364 A 9/1990 Guerin et al.
4,978,051 A 12/1990 Tiearney, Jr. et al.
4,982,893 A 1/1991 Ruckle et al.
5,155,755 A 10/1992 Penato et al.
5,159,619 A 10/1992 Benz et al.
5,204,891 A * 4/1993 Woodruff et al. ..... 378/143
5,414,748 A 5/1995 Upadhya
6,487,275 B1 11/2002 Baba et al.
6,504,127 B1 1/2003 McGregor et al.

(Continued)

FOREIGN PATENT DOCUMENTS

WO 2009019645 A2 2/2009

*Primary Examiner* — Anastasia Midkiff

(57) ABSTRACT

An x-ray tube target and method of repairing a damaged x-ray tube target. The x-ray tube target includes an original substrate and a portion of the original substrate that includes a new portion of a substrate and a new target track that is attached to a void in the original substrate. The method includes removal and replacement of damaged materials on used anode targets of x-ray tubes, thereby enabling recovery of used anode targets without the use of expensive and time consuming layer deposition methods. The method also avoids the high costs and long development cycles associated with known repair and refabrication methods for anode targets of x-ray tubes.

10 Claims, 7 Drawing Sheets

U.S. PATENT DOCUMENTS

| | | | | |
|---|---|---|---|---|
| 7,194,066 | B2 | 3/2007 | Tiearney, Jr. et al. | |
| 7,286,893 | B1 | 10/2007 | Mazumder | |
| 7,505,565 | B2 | 3/2009 | Tiearney, Jr. et al. | |
| 2006/0049153 | A1 | 3/2006 | Cahoon et al. | |
| 2007/0041505 | A1 | 2/2007 | Hoffman | |
| 2008/0069306 | A1* | 3/2008 | Hockersmith et al. | 378/143 |
| 2008/0217381 | A1 | 9/2008 | Meyer et al. | |
| 2011/0211676 | A1* | 9/2011 | Dorscheid et al. | 378/121 |

* cited by examiner

X-RAY TUBE TARGET AND METHOD OF REPAIRING A DAMAGED X-RAY TUBE TARGET

CROSS-REFERENCE TO RELATED APPLICATIONS

This application is a continuation-in-part of and claims priority to U.S. patent application Ser. No. 11/737,932, filed on Apr. 20, 2007, the disclosure of which is incorporated herein by reference.

BACKGROUND OF THE INVENTION

This disclosure relates generally to x-ray generation systems, and more particularly to an x-ray tube target and a method of repairing a damaged x-ray tube target for x-ray generation.

X-ray tubes generally include a cathode assembly and an anode assembly disposed within at least one vacuum vessel or enclosure. The cathode assembly is positioned at some distance from the anode assembly, and a voltage difference is maintained therebetween in order to extract and accelerate electrons from the cathode assembly towards the anode assembly. This voltage differential generates an electric field gradient having a strength defined by the voltage differential between the anode assembly and cathode assembly divided by the distance therebetween. The anode assembly typically includes a rotating anode target having a target track that is generally fabricated from a refractory metal with a high atomic number, such as tungsten or a tungsten alloy. The rotating anode target is commonly a rotating disk configured so that the heat generated by the absorption of impinging electrons is spread out over a large circumferential area. The cathode assembly typically includes a cathode that emits electrons in the form of a focused electron beam that is accelerated across the voltage difference of a cathode to anode vacuum gap and produces x-rays upon impact with the track of the rotating anode target. Because of the high temperatures generated when the electron beam strikes the target track, it is necessary to rotate the anode target at a high rotational speed. As the electrons impact the target track, the kinetic energy of the electrons is converted to high-energy electromagnetic radiation, or x-rays. X-rays are emitted in all directions. A portion of the x-rays are directed out of the x-ray tube through an x-ray emission window in the x-ray tube housing. The x-rays are then transmitted through an object being imaged and intercepted by a detector that forms an image of the object's internal anatomy, contents or structure.

Newer generation x-ray tubes have increasing demands for providing higher peak power. Higher peak power results in higher peak temperatures occurring in the anode assembly, particularly at the target track. Thus, for increased peak power applied, there are endurance and reliability issues with respect to the anode target. Such effects may be countered to an extent by, for example, spinning the target faster. However, doing so has implications to reliability and performance of other components within the x-ray tube. As a result, there is a greater emphasis in finding materials and solutions for improved performance and higher reliability of anode target structures within an x-ray tube.

Over time, the target track of the anode target and possibly a portion of underlying substrate material may be damaged during use. Recovery rates of damaged anode targets are generally limited to targets with minimal track damage as candidates for reuse. Current methods for target reuse (refabrication and refurbishment) are track thinning and layer deposition. Track thinning includes machining away a portion of the x-ray target layer in attempt to remove the damaged material. This is only applicable to targets having damage limited to less than the full thickness of the focal track layer. Layer deposition includes machining away the x-ray target layer and replacing it with a deposited layer material. This is costly since it requires expensive deposition processes, such as plasma spray, chemical vapor deposition (CVD), physical vapor deposition (PVD), lazer engineered net shape (LENS), or electroplating (plating).

Therefore, there is a need for a method for repairing a damaged x-ray tube anode target that avoids the high costs associated with repairing a damaged anode target by layer deposition methods to achieve x-ray target reuse and enables significant savings in comparison to fabricating new x-ray tube anode targets.

BRIEF DESCRIPTION OF THE INVENTION

In accordance with an aspect of the disclosure, an anode target of an x-ray tube comprising an original substrate, and a portion of the original substrate that includes a new portion of a substrate and a new target track that is attached to a void in the original substrate.

In accordance with an aspect of the disclosure, a method of repairing a damaged anode target of an x-ray tube comprising removing a damaged target track of the damaged anode target; removing a damaged portion of a target substrate underlying the damaged target track creating a void in a substrate of the anode target; attaching a new target track to a new portion of a target substrate; and attaching the new portion of target substrate and the new target track in the void to create a repaired anode target.

In accordance with an aspect of the disclosure, an x-ray tube comprising an anode assembly disposed within a vacuum vessel; a cathode assembly disposed at least partially within the vacuum vessel, the cathode assembly including a cathode configured to generate and transmit an electron beam comprising a plurality of electrons towards an anode target within the anode assembly; and an electrode assembly disposed between the cathode vacuum vessel and the anode vacuum vessel; wherein the anode target comprises an original substrate; and a portion of the original substrate that includes a new portion of a substrate and a new target track that is attached to a void in the original substrate.

In accordance with an aspect of the disclosure, an imaging system comprising an x-ray detector; and an x-ray source having an anode assembly and a cathode assembly, the anode assembly comprising an anode target with an original substrate; and a portion of the original substrate that includes a new portion of a substrate and a new target track that is attached to a void in the original substrate.

Various other features, aspects, and advantages will be made apparent to those skilled in the art from the accompanying drawings and detailed description thereof.

DETAILED DESCRIPTION OF THE INVENTION

Figure 1:
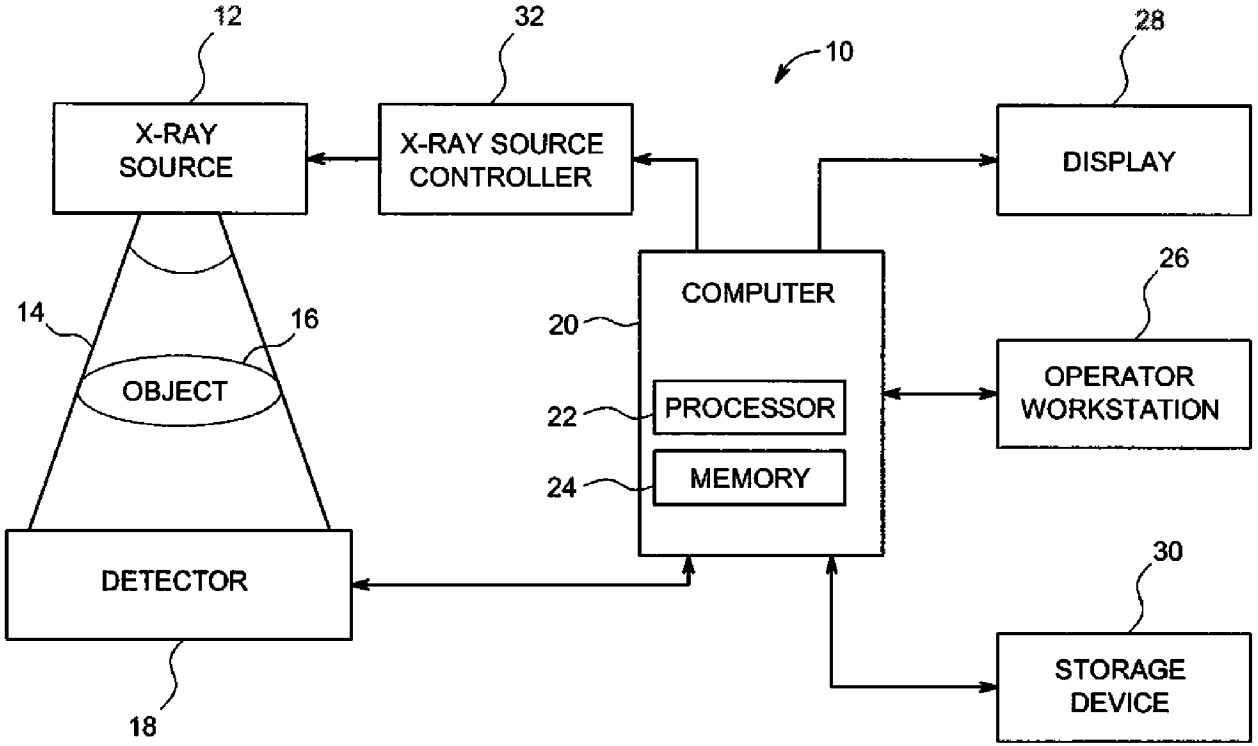
FIG. 1 is a block diagram of an exemplary embodiment of an x-ray imaging system.

Referring now to the drawings, FIG. 1 illustrates a block diagram of an exemplary embodiment of an x-ray imaging system 10 designed both to acquire original image data and to process the image data for display and/or analysis. It will be appreciated by those skilled in the art that this disclosure is applicable to different types of x-ray imaging systems implementing an x-ray tube, such as radiography, mammography, and vascular imaging systems. Other imaging systems such as computed tomography (CT) systems and digital radiography (RAD) systems also benefit from this disclosure. The following discussion of x-ray imaging system 10 is merely an example of one such implementation and is not intended to be limiting in terms of modality.

As shown in FIG. 1, x-ray imaging system 10 includes an x-ray source 12 configured to project a beam of x-rays 14 through an object 16 and towards a detector 18. Object 16 may include human beings, animals, pieces of baggage, or other objects desired to be scanned. X-ray source 12 may include a conventional x-ray tube producing x-ray photons possessing a wide energy spectrum. The x-ray beam 14 generated by x-ray source 12 passes through object 16 and, after being attenuated by object 16, impinges upon detector 18. The detector 18 converts x-ray photons received on its surface to lower energy photons, and subsequently to electrical signals that represent the intensity of the impinging x-ray beam, and hence the attenuated x-ray beam, as it passes through object 16. The electrical signals are transmitted to a computer 20.

The computer 20, including at least one processor 22 and associated memory 24, receives the electrical signals from detector 18 and generates images corresponding to the internal anatomy, contents or structure of the object 16 being imaged. The at least one processor 22 may carry out various functionality in accordance with routines stored in the associated memory 24. The associated memory 24 may also serve to store configuration parameters, operational logs, raw and/or processed image data, and so forth.

The computer 20 may be coupled to a range of external devices via a communications interface. The computer 20 communicates with an operator workstation 26 to enable an operator (not shown), using operator workstation 26, to control the imaging parameters and to view the acquired images. The operator workstation 26 includes some form of operator interface, such as a keyboard, mouse, voice activated controller, or any other suitable input device (not shown) that allows an operator to control the x-ray imaging system 10 and view reconstructed images or other data from computer 20 on a display 28. Additionally, operator workstation 26 allows an operator to store acquired images in at least one storage device 30, which may include hard drives, tape drives, floppy discs, compact discs (CDs), digital versatile discs (DVDs), flash memory storage devices, universal serial bus (USB) storage devices, FireWire storage devices, network storage devices, etc. The operator may also use workstation 26 to provide commands and instructions to computer 20 for controlling operation of an x-ray source controller 32 that provides power and timing signals to x-ray source 12. The computer 20 is coupled to x-ray source controller 32, which in turn is coupled to x-ray source 12 for controlling operation of x-ray source 12.

Figure 2:
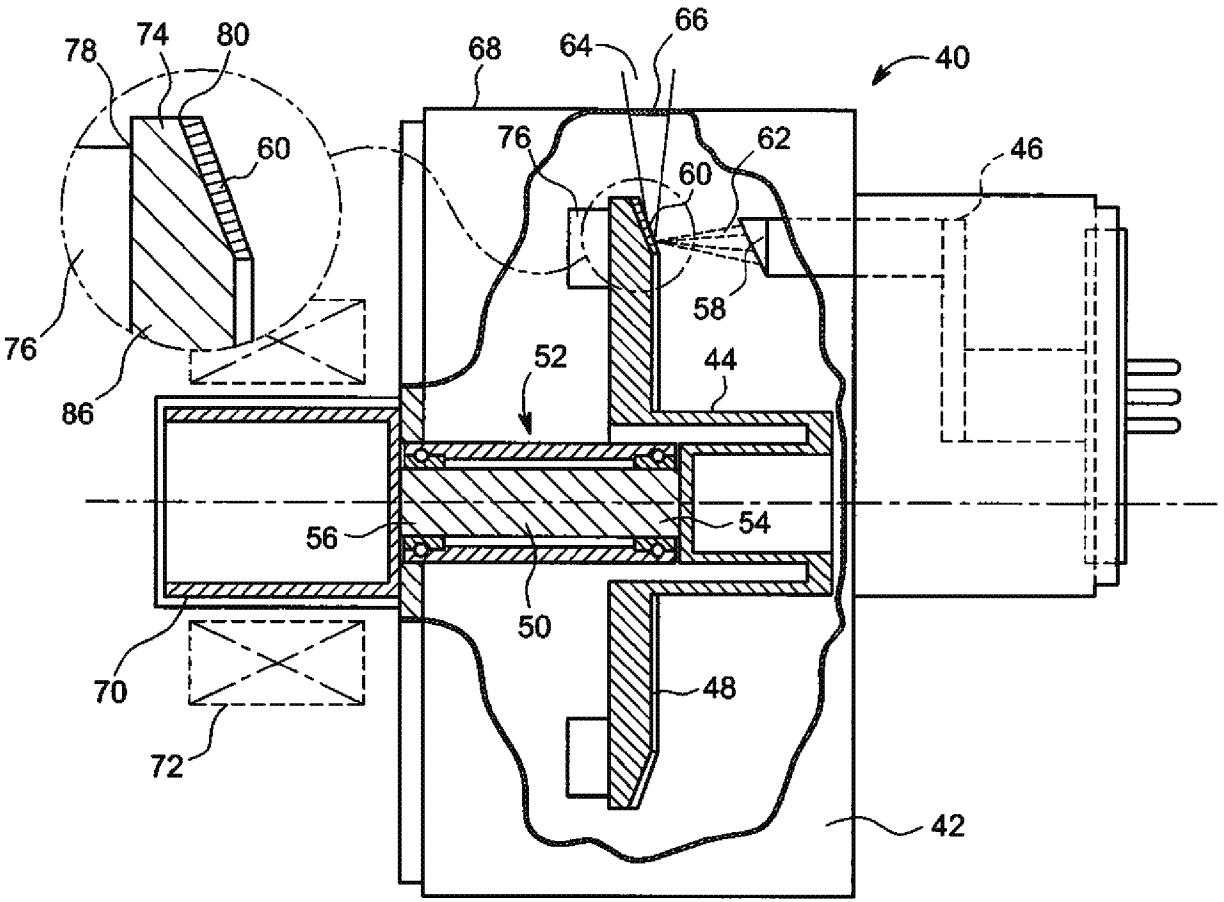
FIG. 2 is a cross-sectional schematic diagram of an exemplary embodiment of a portion of an x-ray tube usable with the system of FIG. 1.

FIG. 2 illustrates a cross-sectional schematic diagram of an exemplary embodiment of a portion of an x-ray tube 40. The x-ray tube 40 includes at least one substantially evacuated vacuum vessel 42 that is situated within a casing (not shown). There is an open chamber (not shown) between the at least one vacuum vessel 42 and the casing. The at least one vacuum vessel 42 is constructed to endure very high temperatures and includes an anode assembly 44 and a cathode assembly 46, which are at least partially disposed therein. The casing may be lined with lead to shield and prevent any extraneous x-ray radiation from straying from the x-ray tube 40. The open chamber between the casing and the at least one vacuum vessel 42 may be filled with a heat absorbing cooling fluid such as, for example, a dielectric oil. The cooling fluid may be circulated through the open chamber by a pump to absorb heat from the at least one vacuum vessel 42 and other components of the x-ray tube, preventing damage thereto. In addition to absorbing heat from the at least one vacuum vessel 42 and other components of the x-ray tube, the cooling fluid also provides electrical insulation between high voltage receptacles for coupling power to the anode assembly 44 and cathode assembly 46, the casing, and the at least one vacuum vessel 42.

The anode assembly 44 includes a rotating anode target 48 mounted to a first end 54 of a rotatable shaft 50. A second end 56 of the rotatable shaft 50, opposite the first end 54, is coupled to a rotor 70 that rotates the rotatable shaft 50 and anode target 48 at a very high angular velocity. The rotatable shaft 50 extends from the rotor 70 at the second end 56 thereof into the at least one vacuum vessel 42 with the anode target 48 attached to the first end 54 thereof. A bearing assembly 52 is coupled around the rotatable shaft 50 to hermetically seal the at least one vacuum vessel 42 and allow the rotatable shaft 50 to rotate. A stator 72 is positioned radially around the rotor 70 to rotationally drive the rotor 70, the rotatable shaft 50 and the anode target 48 attached thereto. The cathode assembly 46 includes a cathode electron emitter 58 spaced apart from and positioned opposite the anode target 48 within the at least one vacuum vessel 42.

The anode target 48 includes a target track 60 bonded to a front surface 80 of a target substrate 74 on an outer portion 86 of the anode target 48. The target track 60 is positioned directly opposite the cathode electron emitter 58, such that an electron beam 62 emitted by the cathode electron emitter 58 will strike the target track 60. The target track 60 may be a circular ring of material that is bonded to the front surface 80 of the target substrate 74. In an exemplary embodiment, the target track 60 may be comprised of a material with a high atomic number, and which has both a high density and high melting point.

During operation, when the x-ray tube 40 is energized by a high voltage electrical power supply (not shown) electrically coupled between the cathode assembly 46 and the anode assembly 44, a focused electron beam 62 is emitted from the cathode electron emitter 58 and directed toward the target track 60 on the anode target 48. As the electron beam 62 strikes the target track 60, x-rays 64 are generated. The generated x-rays 64 pass through an x-ray emission window 66 attached to a frame 68 of the at least one vacuum vessel 42. The x-ray emission window 66 is attached and hermetically sealed to the frame 68 of the at least one vacuum vessel 42 in order to maintain a vacuum therein. In an exemplary embodiment, the x-ray emission window 66 may be attached to the frame 68 through brazing, soldering, welding, diffusion bonding, or any other bonding method. In an exemplary embodiment, the x-ray emission window 66 may be comprised of beryllium, however, alternate materials that allow the transmission of x-rays 64 therethrough may also be used.

In an exemplary embodiment, a heat storage member 76 may be attached to a rear surface 78 of the target substrate 74. The heat storage member 76 may be used to sink and/or dissipate heat built-up from the target track 60 of the anode target 48. In an exemplary embodiment, the heat storage member 76 may be comprised of graphite, or any other heat sinking or heat dissipating material. In an exemplary embodiment, the heat storage member 76 may be attached to the rear surface 78 of the target substrate 74 through brazing, soldering, welding, diffusion bonding, or any other bonding method.

Figure 3:
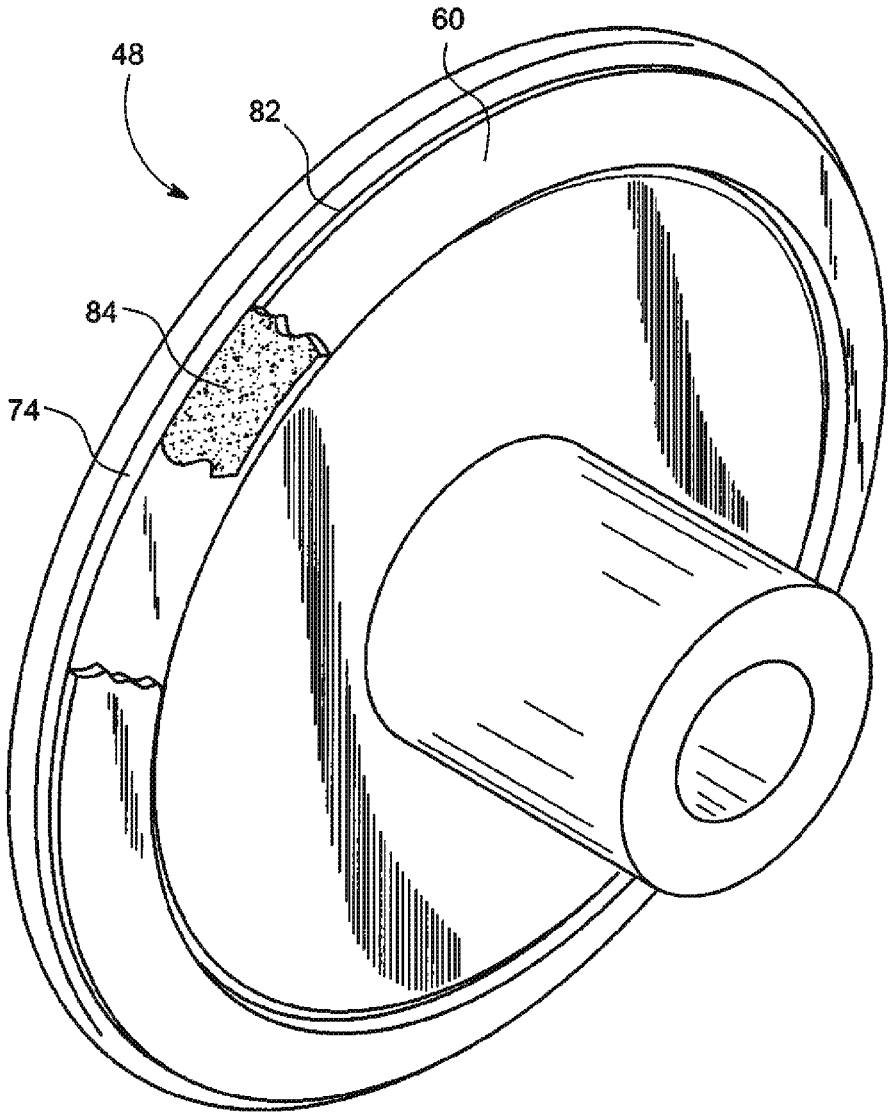
FIG. 3 is a perspective view schematic diagram of an exemplary embodiment of an anode target of the x-ray tube of FIG. 2.

FIG. 3 illustrates a perspective view schematic diagram of an exemplary embodiment of the anode target 48 of the x-ray tube 40 of FIG. 2. The anode target 48 includes a target substrate 74 having target track 60 attached thereto. In an exemplary embodiment, the target substrate 74 may be comprised of a material selected from the group comprising molybdenum, rhenium, zirconium, beryllium, nickel, titanium, niobium and alloys of these materials, including superalloys. In an exemplary embodiment, the target track 60 may be comprised of material comprising tungsten or a tungsten alloy. In an exemplary embodiment, the material of the target substrate 74 and/or the target track 60 may be a wrought material.

In an exemplary embodiment, the target track 60 may be attached to the front surface 80 of the target substrate 74 through brazing. A braze joint 82, attaches the target track 60 to the target substrate 74. The braze joint 82 is formed using a braze material 84 such as a braze foil, a braze paste, or a braze coating. In an exemplary embodiment, the braze material 84 may be selected from a group of material comprising zirconium, titanium, vanadium, platinum, or the like.

The braze material 84 may be applied between the target substrate 74 and the target track 60 by either applying it separately therebetween or by applying it to one or both of the target substrate 74 and target track 60 prior to elevating the temperature thereof in a known braze process. In an exemplary embodiment, the target substrate 74 may be angled according to a desired track angle. In an exemplary embodiment, the braze joint 82 may be formed by applying the braze material 84 between the track substrate 74 and target track 60. Once the braze material 84 is applied, the target track 60 is pressurized or otherwise pressed against the target substrate 74. While under pressure, the temperature of the anode target 48, including the target substrate 74, braze material 84, and target track 60, is raised to or above a braze diffusion temperature of the braze material 84 but below a melt temperature of the braze material 84. In this manner, both the pressure and the heat allow the braze material 84 to interdiffuse with the target substrate 74 and the target track 60 and form a braze joint 82 therebetween. Accordingly, the braze joint 82 is formed without raising the temperature above the melt temperature of the braze material 84. Therefore, the braze joint 82 has a melt temperature much higher than the melt temperature of the braze material 84.

In an exemplary embodiment, the braze joint 82 may be formed by heating the anode target 48, including the target substrate 74, braze material 84, and target track 60 above the melt temperature of the braze material 84. An advantage of raising the anode target 48 above the melt temperature of the braze material 84 is that high pressure may not be necessary in order to form the braze joint 82.

Figure 4:
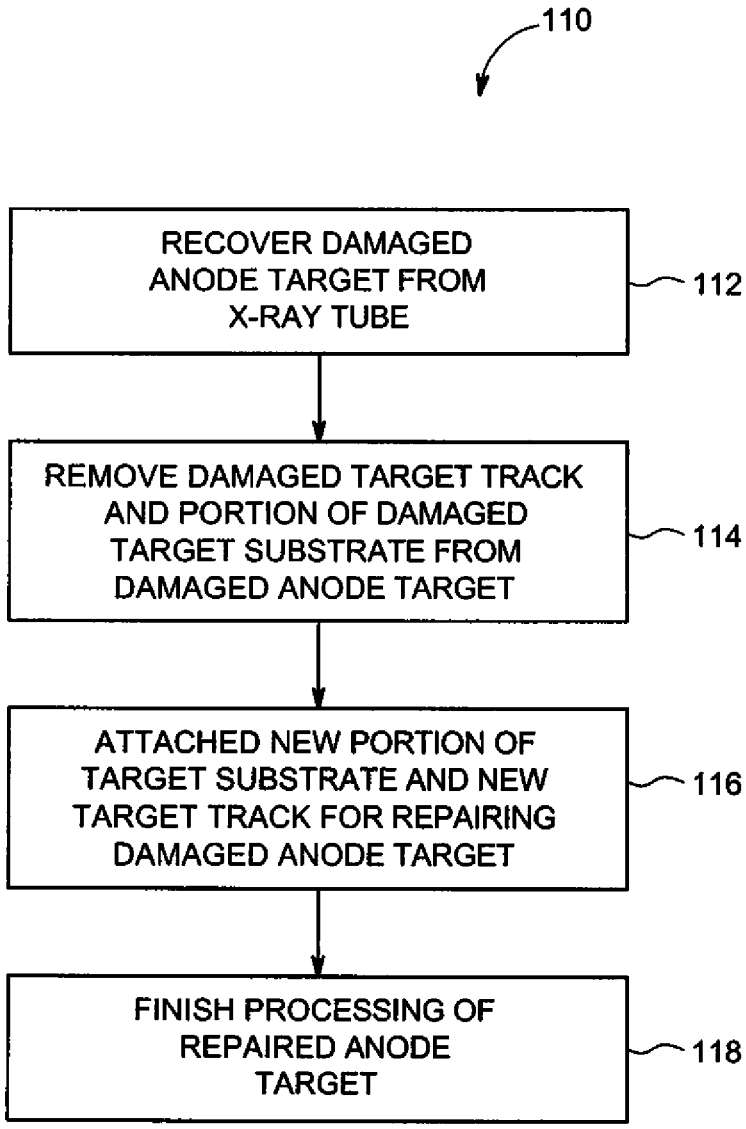
FIG. 4 is a flow diagram of an exemplary embodiment of a method of repairing a damaged anode target.
Figure 5:
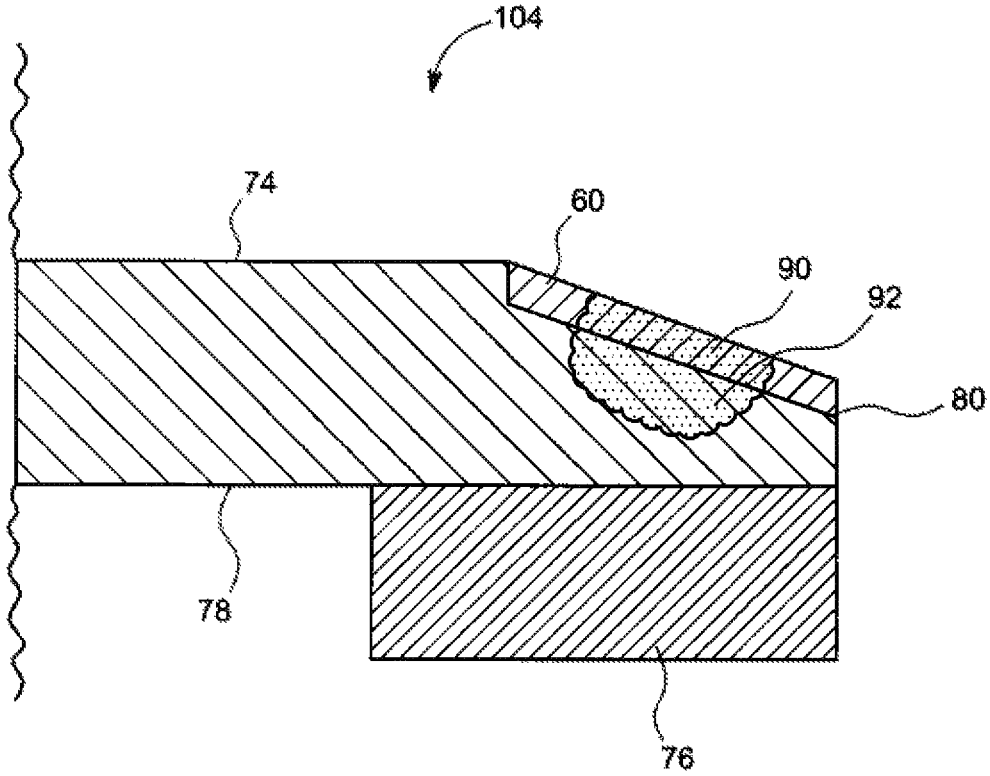
FIG. 5 is a schematic diagram of an exemplary embodiment of a portion of a damaged anode target.

FIG. 4 illustrates a flow diagram of an exemplary embodiment of a method 110 of repairing a damaged anode target 104. The method 110 involves recovering an existing anode target having a damaged area removed and then reconstructing the anode target to a like new condition. The present method enables reuse of damaged anode targets by removal and replacement of a damaged target track and an underlying damaged target substrate. The method 110 begins with recovering a damaged anode target from a used x-ray tube 112. A damaged anode target 104 with a damaged target track 90 and a damaged portion of a target substrate 92 is shown in FIG. 5.

Figure 6A:
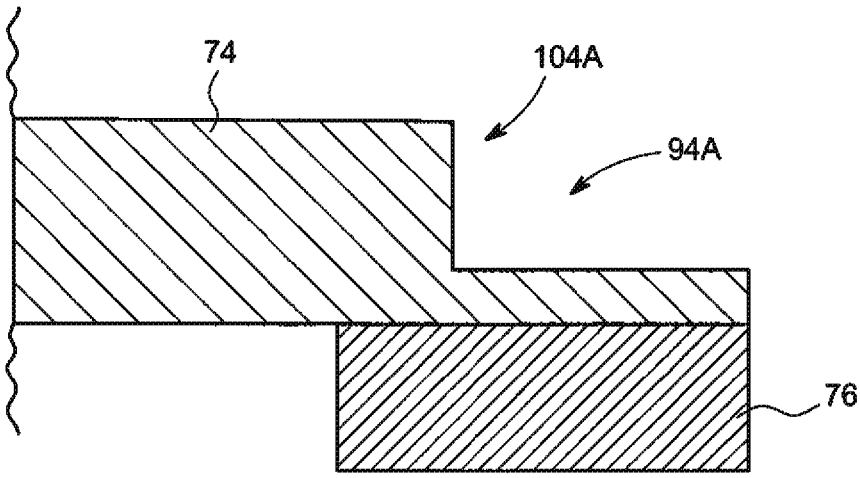
FIGS. 6A, 6B and 6C are schematic diagrams of portions of an anode target illustrating an exemplary embodiment of a method of repairing a damaged anode target.
Figure 7A:
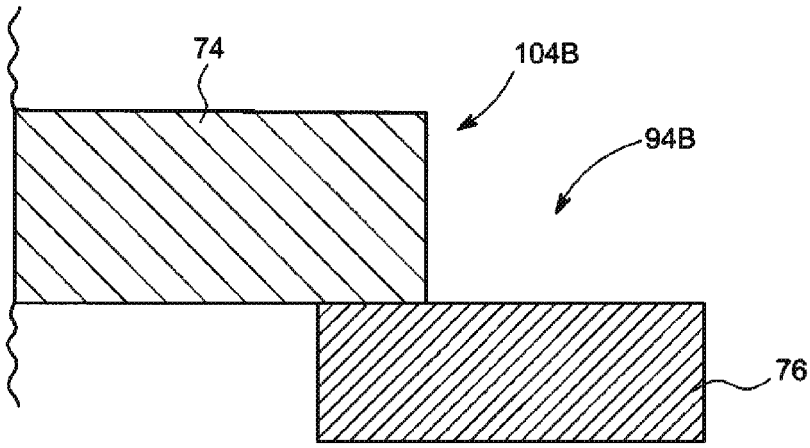
FIGS. 7A, 7B and 7C are schematic diagrams of portions of an anode target illustrating an exemplary embodiment of a method of repairing a damaged anode target.

Another step of the method 110 includes removing a damaged target track and an underlying damaged portion of a target substrate 114. This step is illustrated in FIGS. 6A and 7A, and is described in more detail below with reference to FIGS. 6A and 7A. The damaged target track 60 may be a circular ring of material that is attached to a front surface 80 of the target substrate 74. In an exemplary embodiment, the damaged target track and underlying damaged portion of the target substrate is removed by machining away the damaged target track and the damaged portion of the target substrate.

Figure 6B:
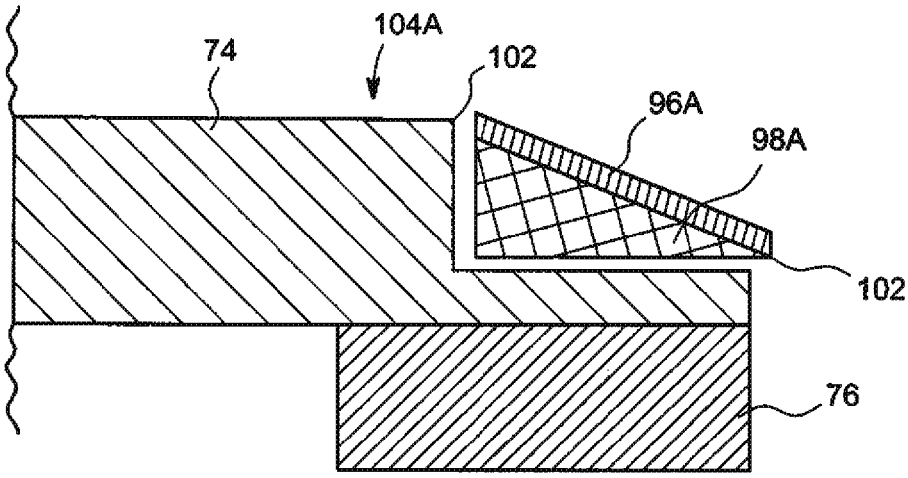
Figure 7B:
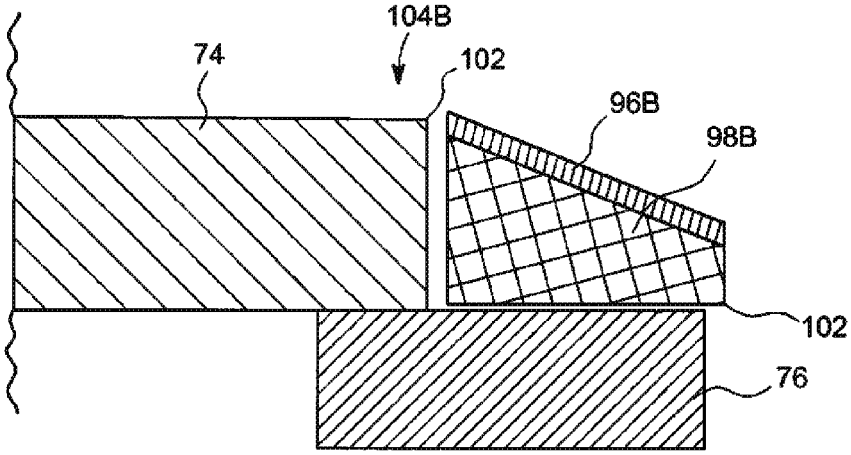

Another step of the method 110 includes attaching a new portion of target substrate and a new target track to the removed portion of the anode target 116. This step is illustrated in FIGS. 6B and 7B, and is described in more detail below with reference to FIGS. 6B and 7B. In an exemplary embodiment, the new portion of the target substrate and the new target track may be attached to the machined away portion of the damaged target track and target substrate by brazing, soldering, welding, diffusion bonding, or any other bonding method.

In an exemplary embodiment, another step of the method 110 may include finish processing of the repaired anode target 118. The finish processing may include finish machining and outgassing processes of the anode target to achieve the desired geometry and finish of the repaired anode target. This step is illustrated in FIGS. 6C and 7C, and is described in more detail below with reference to FIGS. 6C and 7C.

The present method involves removal and replacement of damaged materials on used anode targets of x-ray tubes, thereby enabling recovery of used anode targets without use of expensive and time consuming layer deposition methods. The present method avoids the high costs and long development cycles associated with known repair and refabrication methods.

FIG. 5 is a schematic diagram of an exemplary embodiment of a portion of a damaged anode target 104. The damaged anode target 104 includes a damaged target track 90 and a damaged portion of a target substrate 92. The damaged target track 90 may be a circular ring of material that is bonded to the front surface 80 of the target substrate 74. In an exemplary embodiment, the target substrate 74 may be comprised of a material selected from the group comprising molybdenum, rhenium, zirconium, beryllium, nickel, titanium, niobium and alloys of these materials, including superalloys. In an exemplary embodiment, the target track 60 may be comprised of material comprising tungsten or a tungsten alloy. In an exemplary embodiment, a heat storage member 76 may be attached to a rear surface 78 of the target substrate 74. The heat storage member 76 may be used to sink and/or dissipate heat built-up from the target track 60 of the anode target.

Figure 6C:
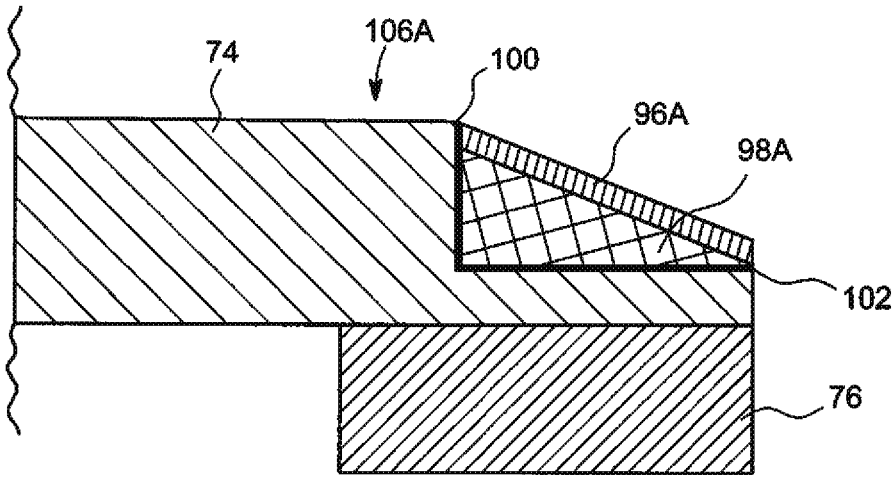
Figure 7C:
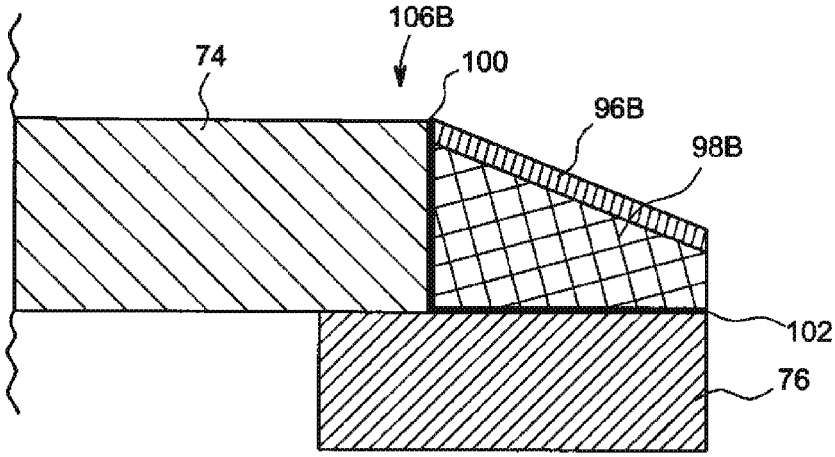

FIGS. 6A, 6B and 6C are schematic diagrams of portions of an anode target illustrating an exemplary embodiment of a method of repairing a damaged anode target. FIG. 6A illustrates a damaged anode target 104A with the damaged target track and underlying damaged portion of a target substrate removed. This creates a void 94A in the damaged anode target 104A where the damaged target track and damaged portion of the target substrate were machined away. FIG. 6B illustrates attaching a new portion of target substrate 98A and a new target track 96A in the void 94A of the damaged anode target 104A.

In an exemplary embodiment, the new target track 96A may be produced via a conventional press-sinter-forge (PSF) process. In an exemplary embodiment, the new portion of the target substrate 98A may be produced via a conventional PSF process. In an exemplary embodiment, the new target track 96A and the new portion of the target substrate 98A may be produced together or co-processed via a PSF process. In an exemplary embodiment, the new target track 96A may be attached to a surface of the new portion of the target substrate 98A by brazing, soldering, welding, diffusion bonding, PSF processing or any other bonding method. In an exemplary embodiment, the new portion of the target substrate 98A and the new target track 96A may be attached to the machined away portion of the damaged target track and target substrate by brazing, soldering, welding, diffusion bonding, or any other bonding method.

During a brazing process, a braze joint 100 is formed using a braze material 102 such as a braze foil, a braze paste, or a braze coating. In an exemplary embodiment, the braze material 102 may be selected from a group of material comprising zirconium, titanium, vanadium, platinum, or the like. In an exemplary embodiment, the braze material 102 may be applied between the target substrate 74, the new portion of the target substrate 98A and the new target track 96A by either applying it separately therebetween or by applying it to one or all of the target substrate 74, the new portion of the target substrate 98A and the new target track 96A. Once the braze material 102 is applied, pressure and high temperature may be applied to the new target track 96A, new portion of target substrate 98A, target substrate 74 and braze material 102 to allow the braze material 102 to interdiffuse with the target substrate 74 and the new target track 96A and new portion of target substrate 98A to form the braze joint 100.

In an exemplary embodiment, the target substrate 74 may be comprised of a material selected from the group comprising molybdenum, rhenium, zirconium, beryllium, nickel, titanium, niobium and alloys of these materials, including superalloys. In an exemplary embodiment, the target substrate 74 may be a non-PSF substrate material. In an exemplary embodiment, the target substrate 74 may be a wrought material. In an exemplary embodiment, the target substrate 74 may be a non-wrought material.

FIG. 6C illustrates a repaired anode target 106A with a new portion of a target substrate 98A and a new target track 96A attached to the target substrate 74. The repaired anode target 106A may be finish processed by finish machining, cleaning and outgassing to achieve the repaired anode target 106A.

In an exemplary embodiment, the new target substrate 98A may be comprised of a material selected from the group comprising molybdenum, rhenium, zirconium, beryllium, nickel, titanium, niobium and alloys of these materials, including superalloys. In an exemplary embodiment, the new target track 96A may be comprised of material comprising tungsten or a tungsten alloy.

FIGS. 7A, 7B and 7C are schematic diagrams of portions of an anode target illustrating an exemplary embodiment of a method of repairing a damaged anode target. FIG. 7A illustrates a damaged anode target 104B with the damaged target track and damaged portion of a target substrate completely removed. This creates a void 94B in the damaged anode target 104B where the damaged target track and damaged portion of the target substrate were machined away. FIG. 7B illustrates attaching a new portion of target substrate 98B and a new target track 96B in the void 94B of the damaged anode target 104B.

In an exemplary embodiment, the new target track 96B may be produced via a conventional PSF process. In an exemplary embodiment, the new portion of the target substrate 98B may be produced via a conventional PSF process. In an exemplary embodiment, the new target track 96B and the new portion of the target substrate 98B may be produced together or co-processed via a PSF process. In an exemplary embodiment, the new target track 96B may be attached to a surface of the new portion of the target substrate 98B by brazing, soldering, welding, diffusion bonding, PSF processing or any other bonding method. In an exemplary embodiment, the new portion of the target substrate 98B and the new target track 96B may be attached to the machined away portion of the damaged target track and target substrate by brazing, soldering, welding, diffusion bonding, or any other bonding method.

During a brazing process, a braze joint 100 is formed using a braze material 102 such as a braze foil, a braze paste, or a braze coating. In an exemplary embodiment, the braze material 102 may be selected from a group of material comprising zirconium, titanium, vanadium, platinum, or the like. In an exemplary embodiment, the braze material 102 may be applied between the target substrate 74, the new portion of the target substrate 98B and the new target track 96B by either applying it separately therebetween or by applying it to one or all of the target substrate 74, the new portion of the target substrate 98B and the new target track 96B. Once the braze material 102 is applied, pressure and high temperature may be applied to the new target track 96B, new portion of target substrate 98B, target substrate 74 and braze material 102 to allow the braze material 102 to interdiffuse with the target substrate 74 and the new target track 96B and new portion of target substrate 98B to form the braze joint 100.

In an exemplary embodiment, the target substrate 74 may be comprised of a material selected from the group comprising molybdenum, rhenium, zirconium, beryllium, nickel, titanium, niobium and alloys of these materials, including superalloys. In an exemplary embodiment, the target substrate 74 may be a non-PSF substrate material. In an exemplary embodiment, the target substrate 74 may be a wrought material. In an exemplary embodiment, the target substrate 74 may be a non-wrought material.

FIG. 6C illustrates a repaired anode target 106B with a new portion of a target substrate 98B and a new target track 96B attached to the target substrate 74. The repaired anode target 106B may be finish processed by finish machining, cleaning and outgassing to achieve the repaired anode target 106B.

In an exemplary embodiment, the new target substrate 98B may be comprised of a material selected from the group comprising molybdenum, rhenium, zirconium, beryllium, nickel, titanium, niobium and alloys of these materials, including superalloys. In an exemplary embodiment, the new target track 96B may be comprised of material comprising tungsten or a tungsten alloy.

While the disclosure has been described with reference to various embodiments, those skilled in the art will appreciate that certain substitutions, alterations and omissions may be made to the embodiments without departing from the spirit of the disclosure. Accordingly, the foregoing description is meant to be exemplary only, and should not limit the scope of the disclosure as set forth in the following claims.

What is claimed is:

1. A method of repairing an x-ray target assembly comprising:

removing a damaged target track of the x-ray target assembly, wherein the damaged target track is a complete undivided circular ring of material positioned on a top surface of a target substrate;

removing a damaged portion of the target substrate underlying the damaged target track creating a complete undivided circular void in the target substrate of the x-ray target assembly, wherein the damaged portion of the target substrate is a complete undivided circular ring of material;

attaching a new target track to a new portion of a target substrate; and attaching the new portion of target substrate and the new target track in the complete undivided circular void in the target substrate to create a repaired x-ray target assembly.

2. The method of claim 1, wherein removing the damaged target track of the x-ray target assembly includes machining away the damaged target track.

3. The method of claim 1, wherein removing the damaged portion of the target substrate includes machining away the portion of a target substrate underlying the damaged target track.

4. The method of claim 1, wherein attaching the new portion of the target substrate and the new target track in the void includes brazing the new portion of target substrate and the new target track to the substrate of the x-ray target assembly.

5. The method of claim 1, wherein the new portion of the target substrate and the new target track are attached to the complete undivided circular void in the target substrate by one of brazing, soldering, welding, diffusion bonding, or any other bonding method.

6. The method of claim 1, further comprising finish processing of the repaired x-ray target assembly.

7. The method of claim 1, wherein the new target track is produced via a press-sinter-forge (PSF) process.

8. The method of claim 1, wherein the new portion of the target substrate is produced via a PSF process.

9. The method of claim 1, wherein the new target track and the new portion of the target substrate are produced together via a PSF process.

10. The method of claim 1, wherein the new target track is attached to a top surface of the new portion of the target substrate by one of brazing, soldering, welding, diffusion bonding, PSF processing or any other bonding method.

* * * * *